United States Patent [19]

Köbler

[11] Patent Number: 4,767,112

[45] Date of Patent: Aug. 30, 1988

[54] FOLDED COPY PRODUCT TRANSFER AND TRANSPORT APPARATUS

[75] Inventor: Ingo Köbler, Anhausen, Fed. Rep. of Germany

[73] Assignee: M.A.N. Roland Druckmaschinen, Augsburg, Fed. Rep. of Germany

[21] Appl. No.: 10,343

[22] Filed: Feb. 3, 1987

[30] Foreign Application Priority Data

Feb. 6, 1986 [DE] Fed. Rep. of Germany ..... 3603781

[51] Int. Cl.[4] ..... B65H 39/02; B65H 29/04

[52] U.S. Cl. ..... 270/54; 271/204

[58] Field of Search ..... 270/54–56, 270/58; 271/204–206, 277, 82; 198/696

[56] References Cited

U.S. PATENT DOCUMENTS

| | | | |
|---|---|---|---|
| 3,122,362 | 2/1964 | Vollrath et al. | 271/204 |
| 3,730,517 | 5/1973 | Norton | 271/204 |
| 3,955,667 | 5/1976 | Muller et al. | 271/204 |
| 4,126,390 | 11/1978 | Connin | 271/204 |
| 4,381,056 | 4/1983 | Eberle | 271/204 |
| 4,479,645 | 10/1984 | Pullich | 271/204 |
| 4,566,687 | 1/1986 | Faltin | 271/204 |
| 4,602,774 | 7/1986 | Kobler . | |
| 4,604,851 | 8/1986 | Reist | 271/204 |
| 4,605,212 | 8/1986 | Kobler . | |
| 4,605,213 | 8/1986 | Hechler . | |
| 4,666,143 | 5/1987 | Reist | 271/204 |

FOREIGN PATENT DOCUMENTS

| | | | |
|---|---|---|---|
| 2822060 | 12/1978 | Fed. Rep. of Germany | 271/204 |

*Primary Examiner*—Eugene H. Eickholt

*Attorney, Agent, or Firm*—Frishauf, Holtz, Goodman & Woodward

[57] ABSTRACT

To transport folded copy products without engaging an arm between the creased or folded sheets of a folded copy product, a sprocket chain (10) has gripper arms (9) secured thereto which have gripper elements (11) at the remote end. The gripper elements are guided in an arcuate path (11') at a transfer position or station (7), the folded copy products (10) being pushed between a counter surface (**11*a*) and a movable tongue (11*b*) of the gripper elements which, then, close under spring pressure. The gripper elements can open and close under control of a cam (18,17) to receive the copy products. The copy products can be transported in imbricated or shingled position to a reception or delivery station (14,27**).

10 Claims, 3 Drawing Sheets

FOLDED COPY PRODUCT TRANSFER AND TRANSPORT APPARATUS

Reference to related patents, the disclosure of which is hereby incorporated by reference:

U.S. No. 4,602,774, July 29, 1986, Kobler;

U.S. No. 4,605,212, Aug. 12, 1986, Kobler;

U.S. No. 4,605,213, Aug. 12, 1986, Hechler.

The present invention relates to apparatus to handle folded copy products, for example folded sheets of news print, and more particularly to such apparatus to receive and transport the folded copy products. Typically, the folded copy products are received from a rotating folding apparatus and are transported by an endless transport system, for example a transport belt or chain to a delivery or reception station, for presenting the folded products, for example in imbricated or intercalated, or shingled form, or, selectively, for further transport by another transport apparatus.

BACKGROUND

U.S. Pat. No. 4,602,774, Kobler (to which German Patent DE-PS No. 34 28 512 corresponds) describes an apparatus to receive folded paper products, in which the folded paper products are directly received from a folding apparatus and transported with reduced speed to a further transport apparatus or to a delivery station or to further paper handling apparatus. The structure described in this patent utilizes carrier elements which are introduced behind the folded crease before the folded sheet elements of the copy close, that is, while the respectively folded sheet portions are still spread apart, or in flared condition. The arrangement permits introduction of the carrier elements, typically held on a transport belt or chain into the folded products without using a separate element to open or spread apart the folded sheet portions. The folded products can thus be collected or inserts placed therein.

THE INVENTION

It is an object to improve the described apparatus which permits direct reception of the folded product from a folding apparatus and to transport it at a reduced speed, in such a manner that reception of the folded apparatus is possible after the fold has already been made.

Briefly, the carrier elements, secured to an endless transport arrangement, such as a chain, belt or the like, is constructed in the form of gripper arms, having gripper elements located at the remote ends of the arms, that is, at the ends of the arms remote from the transport belt or chain. A deflection pulley, about which the transport belt or chain is partly looped, is located in the vicinity of a transfer position of the folded sheet elements from a folding apparatus, typically a rotating cylinder and also forming a folded sheet feed element. The gripper elements describe an arcuate path, such that the linear speed of the gripper elements, traveling about the circumference of an arc, the center of which is defined by the deflection pulley, is greater than the linear speed of the transport means which is looped about the deflection pulley. The gripper elements grip the folded products at their leading edge and transport the folding products, by gripping the folded or creased edge, then at the linear speed of the transport belt or chain, to a reception apparatus to receive the transported folded copy products. The reception apparatus may be a delivery station, to deliver the folded copy products in imbricated, or shingled arrangement or, selectively, a further transport system to which the gripped products are delivered. The further transport system may be an extension of the existing transport belt or chain, or a further transport chain or belt system similar to that receiving the folded products from the folding apparatus.

The arrangement has the advantage that the folded products can be gripped directly, and insertion of a projecting, gripping arm between spread-apart folded sheet portions of the folded copy products is no longer necessary.

DRAWINGS

DETAILED DESCRIPTION

Figure 1:
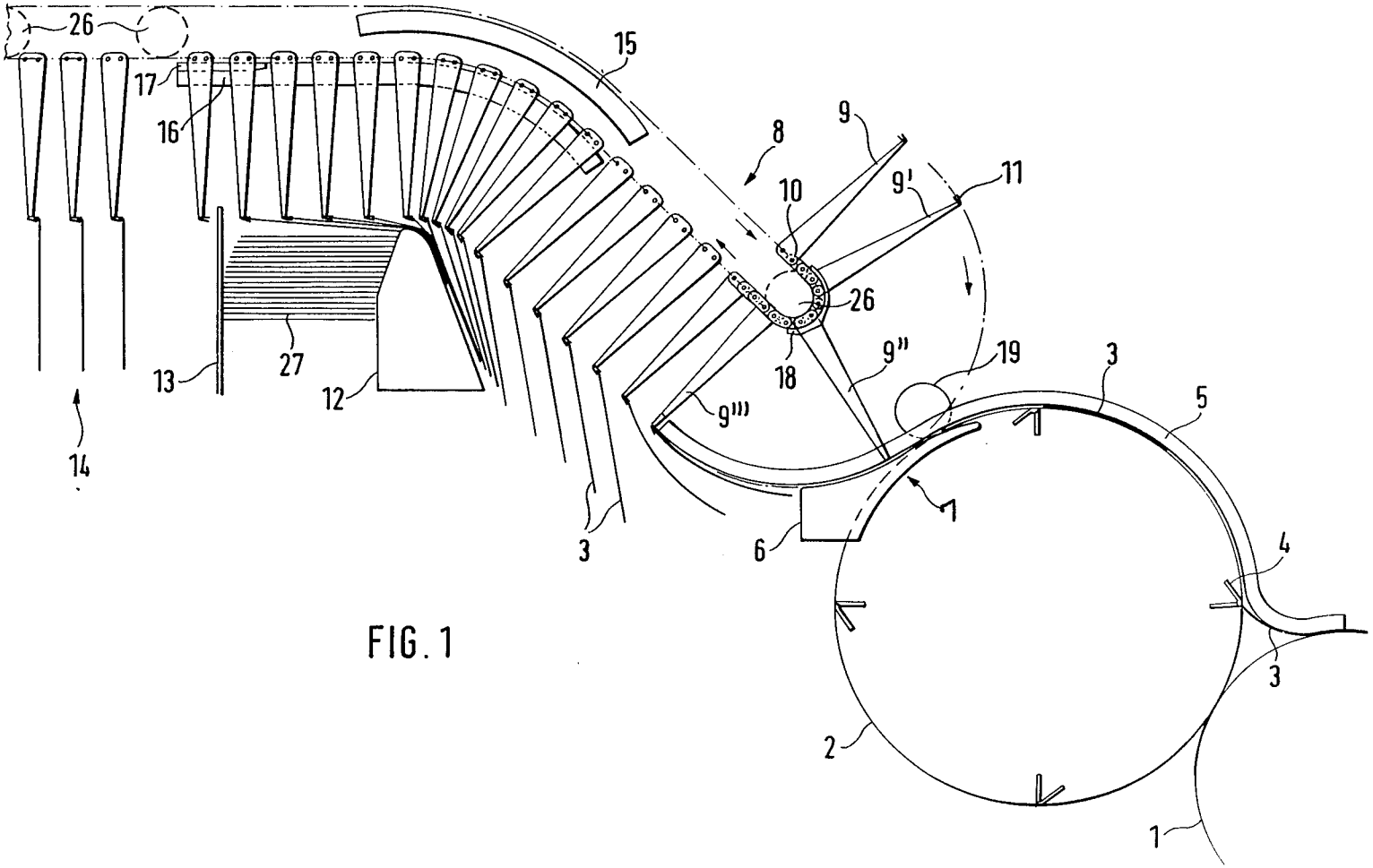
FIG. 1 is a schematic side view, partly in fragmentary representation, illustrating the overall structure of the apparatus to receive and transport folded copy elements.

A sheet collection cylinder 1 transports sheets to a folding groove and flap cylinder 2 to form folded products 3 thereon. This construction is standard and may be in accordance with any well-known, suitable folding cylinder-folding blade structure. After release of the folded sheets 3 from the folding flaps 4, they are guided between two fixed deflection tongues 5,6 to a folded product transfer station 7. An endless transport means 8, preferably a chain 10 (FIG. 3) guides spaced gripper arms 9 passed the folded product transfer station 7. The arrangement is so made—see FIGS. 1 and 2—that the gripper arms 10, which are located in predetermined staggered space distance from each other, are first guided in an essentially linear, or otherwise desired path about an arcuate path, the center of which is formed by the center of rotation of a deflection pulley 26 about which the chain is guided. By change-over of the essentially linear path of the gripper arms 9 to the arcuate movement at the folded product transfer station, the linear speed at the tip of the gripper arms will be increased with respect to that of the linear speed of the belt or chain 10.

In accordance with the present invention, the arms 9 are formed as gripper arms with grippers 11 at the remote ends thereon, that is, at the ends remote from the chain 10. The grippers 11 have a rigidly connected gripper counter surface 11*a*—see FIGS. 2 to 4—which intermesh with movable gripper tongues 11*b*. A plurality of such gripper arms 9 may be located next to each other, corresponding to the width of the folded products 3 to be picked up and transported, each one of the gripper arms being formed with the grippers 11. The grippers 11, of course, also may have suitable widths, depending on the width of the folded products to be seized and transported.

In accordance with a feature of the invention, the folded products are transferred between the gripper counter surface 11*a* and the gripper tongues 11*b* at the folded product transfer station 7. At that position, the grippers are open, that is, the tongues 11*b* are separated from the counter surface 11*a*. The speed of the folded product 3 at the transfer position must be somewhat higher than the speed of the grippers moving past the transport station, so that the folded edge or creased portion of the folded products can be inserted between the counter surface 11*a* and the tongues 11*b*. After transfer into the grippers 11, the grippers close, that is, the tongues 11*b* move towards the counter surface 11*a* and are guided between or along the fixed deflection surfaces 5,6. The deflection surface 6 is preferably somewhat shorter than the deflection surface 5. Due to the centrifugal force acting on the folded products, the portions of the folded products which are not gripped are deflected and flung outwardly. Subsequent to passing through the transfer station, and after having moved through the part circular path, the folded products 3 can be so located that they are already in shingled, or imbricated position with respect to each other. The transport chain 10 is guided in the arcuate path in the region of the folded product transfer station 7 by guidance about the deflection pulley 26 which, preferably, is formed as a sprocket wheel.

Figure 2:
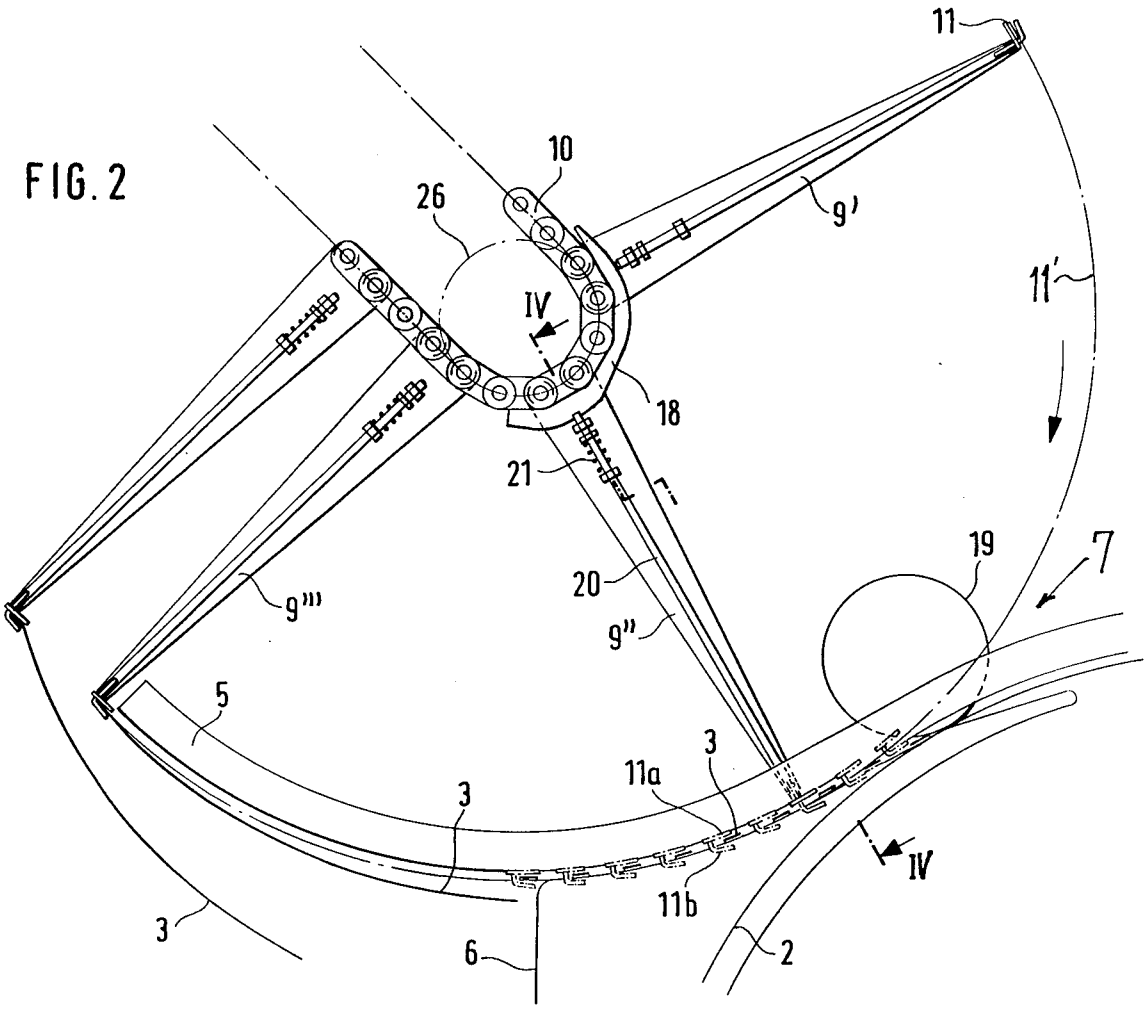
FIG. 2 is an enlarged fragmentary representation of the transfer station.

OPERATION, WITH REFERENCE TO FIG. 2:

The folded copy products 3 are fed into the opened grippers 11 at the transfer station 7. The course of insertion of the folded products 3 between the gripper surface 11*a* and the gripper tongue 11*b* can be assisted by a feed roller 19 which, however, is not strictly necessary. The respective angular positions of the grippers arms 9 are sequentially illustrated in FIG. 2 by positions 9',9'',9'''. As best seen in FIGS. 1 and 2, at position 9'', the folded product 3 begins to be inserted between the gripper counter element 11*a* and the tongue element 11*b* of the gripper. Before the gripper arm 9 reaches the position 9'', the gripper tongue 11*b* is opened and spaced or spread from the counter surface 11*a* by engagement of the push rod 20, which is spring loaded by springs 21 with a suitably shaped cam 18. Upon engagement with cam 18, gripper tongue element 11*b* is spread from the counter surface element 11*a*; the cam 18 is suitably shaped so that, after the folded products have been inserted into the gripper 11, the tongues close against the counter surface so that the folded product 3 is securely clamped between the counter surface 11*a* and the tongue 11*b* and can be reliably transported downstream, with respect to the movement of the chain 10.

FIG. 1 illustrates the further path of the folded products. The transport chain 10 is guided over guide rails 15 and 16 and can be further guided by additional sprocket wheels 26. A further cam element 17, just as cam 18, is used to open the grippers 11, for example, to deposit the folded products in a stack 27. The grippers 11 move at a gripper linear speed which is slower than that of the linear speed at the folded product transfer station 7 when they reach the region of the stack 27. The slowed folded products 3 are guided by a guide element 12 to fit against a stop surface 13, for precise stacked alignment; of course, the position of the guide element 12 and of the guide surface 13 may be selected as desired for the delivery of the folded products. Alternatively, the transport chain 10 can be elongated, or supplied to another transport chain system 14, shown only schematically, for further transport to a different location. The folded products can, of course, also be delivered to some other transport system, such as movable belts or the like. The delivery either on the stack 27 or by a further transport chain section 14 is shown only schematically, since the delivery may be as desired.

The push rod 20—see FIG. 2—engages the cam 18, which associate that the grippers are opened shortly before reaching the periphery of the folding groove and flap cylinder 20. Springs 21 tend to hold the grippers in closed position, the cam 18 moving the push rod counter the force of the springs 21. After insertion of the folded products 3, the grippers are closed, and then the linear speed of the folded products is reduced, with the grippers closed. The path taken by the grippers, and the substantially longer distance, per unit time, of the grippers 11 as they move in the arcuate path, is clearly seen in FIG. 2, where the path of the grippers 11 is shown by the chain dotted line 11'.

Figure 4:
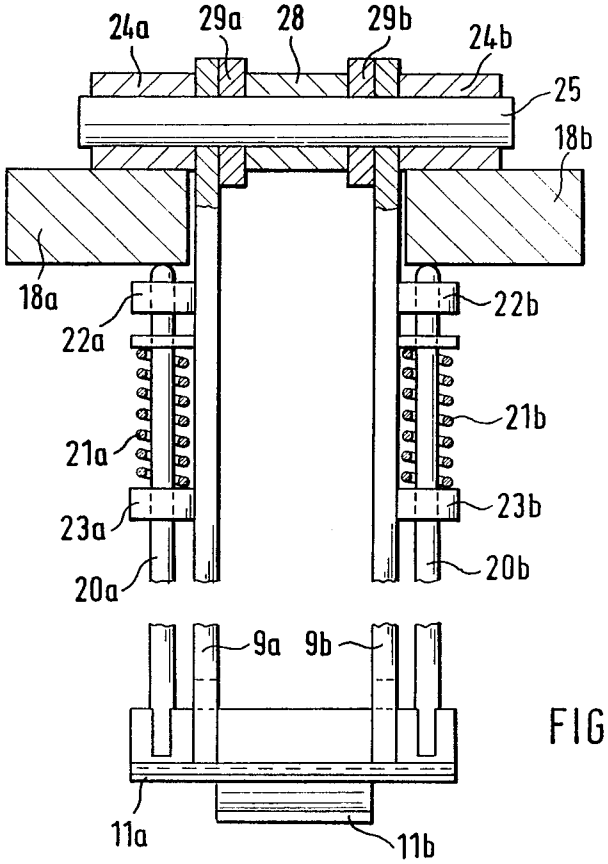
FIG. 4 is a sectional view along the broken section line IV—IV of FIG. 2.
Figure 3:
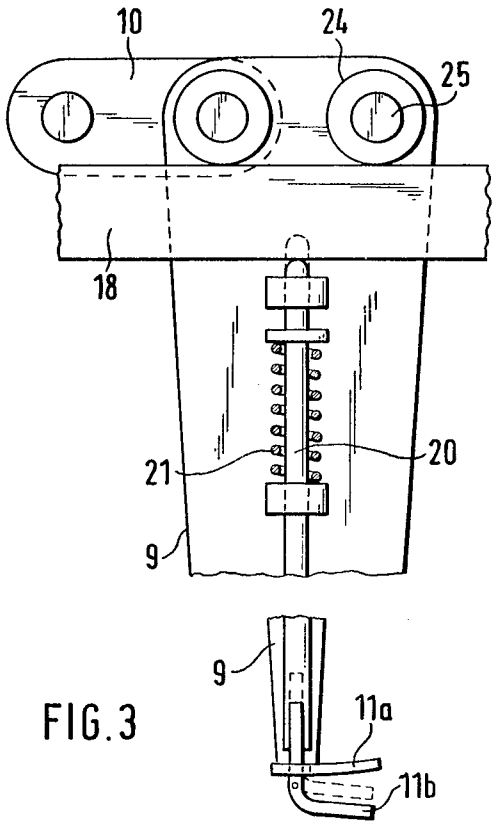
FIG. 3 is a side view of the gripper arm.

The gripper arms 9 and the grippers 11 can be secured to the chain 10 in any suitable manner; in accordance with the preferred feature of the invention, and as best seen in FIGS. 3 and 4, the transport element 10 is a conventional sprocket chain, with conventional chain division. To improve the stability of the overall construction, a double support, that is, double guidance of the grippers 11 on either side of the chain is preferred—see FIG. 4. Thus, the gripper surface 11*a*, as well as the gripper tongue 11*b*, are supported and guided on both sides of the sprocket chain 10. In the description that follows, identical elements have been given identical reference numerals, with the left side in FIG. 4 having the additional subscript a, and the right side of the additional subscript b.

Transport chain 10 includes rollers 28 and link elements 29. In the region of any gripper arm 9, the outer chain elements are extended to form arms. The transverse bolts 25 of the transport chain 10 are elongated and, additionally, carry guide rollers 24 at their ends which, at the inside, support the transport chain 10 with respect to centrifugal forces and control forces as the transport chain runs along the respective cam track 18,17 (FIGS. 1,2).

The push rods 20 transfer control movement counter the force of compression springs 21 to the gripper tongues 11*b*. The push rods 20 are guided in guide bushings 22,23. The gripper counter surface 11*a* is rigid and, secured to the gripper arms 9 to be immovable with respect thereto. The springs 21, thus, provide for closing movement of the gripper tongues 11*b* before and after the grippers have passed the cam tracks 18,17, so that reliable guidance of the folded products 3 is ensured. In addition to the elongated arms 9, the roller chain includes the standard links 29, shown separately only in FIG. 4 at 29*a*,29*b*, spaced by spacer rollers 28.

Various changes and modifications may be made within the scope of the inventive concept.

I claim:

1. Folded copy product transfer and transport apparatus to transfer folded copy products (3) at a transfer position or station (7) from a folding apparatus (1, 2, 4), having a feed element, to an endless transport means (8, 10), said endless transport means (10), comprising a plurality of gripper arms (9) secured, spaced from each other, to the transport means (10) and projecting laterally therefrom;

gripper elements (11) located on the gripper arms remote from the transport means;

a deflection pulley (26) having the transport means partly looped thereabout located in the vicinity of the transfer position (10) and positioned with respect to the copy products (3) being transferred from the folding apparatus (1, 2, 4) such that the gripper elements (11) describe an arcuate path (11')

at a speed which is greater than the linear speed of the transport means, said gripper elements gripping the folded products (3) at end edges for further transport by the transport means at the linear speed thereof;

reception means (14, 27) receiving the transported folded copy products (3) from the transport means; and wherein the feed element of the folding apparatus feeds said folded copy products at a speed which is slightly higher than the linear speed of the gripper elements at the transfer position (7) for insertion of the end edges of the folded copy products (3) into the gripper elements (11).

2. The apparatus of claim 1, further comprising guide tongues (5,6) located at said transfer position and dimensioned and shaped to guide the folded copy products (3) to the gripper elements upon transport by said transport roller (19).

3. The apparatus of claim 1, wherein the gripper elements comprise a counter surface (11*a*) secured to the gripper arms, and a movable tongue (11*b*) movable towards and away from said counter surface, to grip or clamp the folded copy products at the folded or creased edge between said counter surface and gripper tongue.

4. The apparatus of claim 1, further including guide surfaces (5,6), located at said transfer position for guiding the folded copy products at the inside and at the outside of said arcuate path upon transfer to the gripper elements;

and wherein the guide surface located at the outside of the arcuate path is dimensioned and shaped to permit the folded products to move under influence of centrifugal force to result in imbricated or shingled position of adjacent copy products gripped by adjacent gripper elements on the transport means (10).

5. The apparatus of claim 4, wherein the gripper arms (9) are secured to the transport means (10) with spacing which is less than the length of the folded copy products to deliver the folded copy products in imbricated or shingled position to the reception means.

6. The apparatus of claim 1, wherein the transport means (10) comprises a sprocket chain;

the gripper arms (9) are secured to the sprocket chain;

the gripper elements comprising a fixed counter surface (11*a*) and a spring-loaded movable gripper tongue (11*b*) for reception of the creased or folded edge of the copy product (3) therebetween;

and control cam means (18) engaged by a cam followup (20) coupled to the respective tongues (11*b*) of the gripper elements for opening the tongues upon the gripper elements reaching the transfer position (7) and permitting closing of the tongues under spring pressure after gripping of the folded or creased edge of the copy products (3).

7. The apparatus of claim 6, further including delivery cam means (17) located at the reception means (27) and controlling the tongues (11*b*) to open by engagement with the cam followup to permit release of the folded copy product and delivery of the folded copy product to the reception means.

8. The apparatus of claim 1, wherein the gripper elements grip the folded products (3) at the folded edges.

9. The apparatus of claim 1, wherein the transport means delivers the folded products to said reception means (27, 14) at a speed which is less than the speed at which the folded copy products (3) are fed to the transport means by the folding apparatus (1, 2, 4).

10. The apparatus of claim 1, wherein the feed element includes a feed roller (19).

* * * * *